US009963788B2

(12) United States Patent
Wan

(10) Patent No.: US 9,963,788 B2
(45) Date of Patent: May 8, 2018

(54) CONCENTRATE FOR USE IN CORROSION RESISTANT TREATMENT OF METAL SURFACES

(71) Applicant: Henkel AG & Co. KGaA, Duesseldorf (DE)

(72) Inventor: Zongyue Wan, Shanghai (CN)

(73) Assignee: HENKEL AG & CO. KGAA, Duesseldorf (DE)

( * ) Notice: Subject to any disclaimer, the term of this patent is extended or adjusted under 35 U.S.C. 154(b) by 293 days.

(21) Appl. No.: 14/721,131

(22) Filed: May 26, 2015

(65) Prior Publication Data

US 2015/0252481 A1 Sep. 10, 2015

Related U.S. Application Data

(63) Continuation of application No. PCT/CN2012/085633, filed on Nov. 30, 2012.

(51) Int. Cl.
*C23C 22/34* (2006.01)
*C23C 22/50* (2006.01)

(52) U.S. Cl.
CPC ..... *C23C 22/34* (2013.01); *C23C 2222/20* (2013.01)

(58) Field of Classification Search
CPC .... C23C 22/34; C23C 22/361; C23C 2222/20
See application file for complete search history.

(56) References Cited

U.S. PATENT DOCUMENTS

| | | | | |
|---|---|---|---|---|
| 4,828,616 | A | 5/1989 | Yamasoe | |
| 2004/0009300 | A1* | 1/2004 | Shimakura | B05D 7/16 427/407.1 |

FOREIGN PATENT DOCUMENTS

| | | | |
|---|---|---|---|
| CA | 2426081 | A1 | 4/2002 |
| CN | 101346493 | A | 1/2009 |
| CN | 102031508 | A | 4/2011 |
| EP | 1433877 | A1 | 6/2004 |
| EP | 1524332 | A1 | 4/2005 |
| EP | 1455002 | B1 | 7/2009 |
| EP | 1556676 | B1 | 12/2010 |
| WO | 2007065645 | A1 | 6/2007 |
| WO | 2012055908 | A1 | 5/2012 |

OTHER PUBLICATIONS

International Search Report PCT/CN2012/085633, dated Sep. 5, 2013.
Supplementary European Search Report dated Sep. 23, 2016.

* cited by examiner

*Primary Examiner* — Lois Zheng
(74) *Attorney, Agent, or Firm* — Mary K. Cameron

(57) ABSTRACT

The underlying invention consists in an acidic aqueous concentrate that is based on a mixture of water-soluble compounds of the elements Zr and/or Ti, organosilanes and dispersed silicates suitable for the preparation of a conversion treatment solution. The invention thereby establishes a shelf stable (1K) product useful for the surface treatment industry. Such a (1K) product has not only the advantage of being easily converted into a working composition through dilution with water, but the working compositions themselves that originate from the (1K) product do confer superior corrosion resistance to metal substrates when used in a process for the conversion coating treatment. A conversion treatment solution obtainable from the acidic aqueous concentrate as well as a process for the corrosion-resistant treatment of metal surfaces are thus further objects of this invention.

19 Claims, No Drawings

CONCENTRATE FOR USE IN CORROSION RESISTANT TREATMENT OF METAL SURFACES

The underlying invention consists in an acidic aqueous concentrate that is based on a mixture of water-soluble compounds of the elements Zr and/or Ti, organosilanes and dispersed silicates suitable for the preparation of a conversion treatment solution. The invention thereby establishes a shelf stable 1K product useful for the surface treatment industry. Such a 1K product has not only the advantage of being easily converted into a working composition through dilution with water, but the working compositions themselves that originate from the 1K product do confer superior corrosion resistance to metal substrates when used in a process for the conversion coating treatment. A conversion treatment solution obtainable from the acidic aqueous concentrate as well as a process for the corrosion-resistant treatment of metal surfaces are thus further objects of this invention.

Anticorrosion agents that involve an acidic aqueous solution of fluoro complexes have long been known. They are increasingly employed as a replacement for chromating processes that due to the toxicological properties of chromium compounds are less and less used. Generally, solutions of fluoro complexes of this type contain additional anticorrosion agents that further improve the corrosion protection and paint adhesion.

WO 07/065645 likewise discloses aqueous compositions which contain fluoro complexes of inter alia Zr and/or Ti, a further component additionally being present which is selected from: nitrate ions, copper ions, silver ions, vanadium or vanadate ions, bismuth ions, magnesium ions, zinc ions, manganese ions, cobalt ions, nickel ions, tin ions, buffer systems for the pH range from 2.5 to 5.5, aromatic carboxylic acids with at least two groups which contain donor atoms, or derivatives of such carboxylic acids, silica particles with an average particle size of below 1 μm.

EP 1556676 exposes organosilanes to be an useful additive to further increase the corrosion resistance and paint adhesion of conversion coatings generated from chromium-free acidic aqueous solutions. EP 1556676 therefore discloses aqueous compositions comprising compounds of Group IVa metal ions as well as a mixture of an aminosilane and an oxirane-functional silane.

EP 1455002 teaches the usefulness of silicon-containing compounds in acidic chromium-free solutions for the surface treatment of metal surfaces while the silicon-containing compounds are inter alia selected from silica sols and silane-coupling agents. EP 1455002 thereby discloses a pretreatment method for iron material with an acidic aqueous chemical conversion coating agent based on at least one kind selected from the group consisting of zirconium, titanium and hafnium that may additionally comprise silicon-containing compounds.

It is thus known that the performance of chromium-free conversion treatment solutions based on compounds of the elements Zr and/or Ti can be enhanced with the addition of auxiliary compounds. On the other hand the stability of auxiliary compounds in these acidic aqueous conversion treatment solutions is often limited due to manifold reactions that might occur between the different components giving rise to precipitation of active compounds necessary for the conversion of the metal surface thereby limiting the shelf lifetime of concentrates of the working composition as well as the lifetime of the working bath itself. Especially organosilanes are well-known as auxiliary compounds in chromium-free compositions to be capable of promoting the corrosion resistance performance but difficult to stabilize in concentrated solutions as organosilanes are prone to undergo hydrolysis and condensation reactions that result in precipitation of active compounds or gelling of the concentrate. Auxiliary compounds are therefore often mixed directly to ready-to-use conversion coating baths and not delivered together with the other bath ingredients in form of a 1K product.

The problem of the underlying invention that is to be solved therefore consists in establishing a 1K product based on zirconium and/or titanium compounds that upon dilution with water provides a ready-to-use working composition for the conversion treatment of metal surfaces. The 1K product, which is a concentrate of the components of the corresponding working composition, should be stable so that an adequate shelf lifetime of the 1K product is guaranteed. Furthermore, a concentrate of the invention shall after dilution with water yield a working composition that when applied to a metal substrate increases the corrosion resistance and paint adhesion while especially decreasing the flash rust formation on steel substrates upon drying of the conversion treated metal surface.

It was surprisingly found that a highly concentrated aqueous solution of organosilanes, water-soluble compounds of Zr and/or Ti and water-dispersed silicates can be stabilized when making use of essentially nitric acid as a strong acid to adjust the pH to a value below 1.5. Moreover, a conversion treatment solution obtained from the concentrate through dilution with water can efficiently reduce corrosion when applied to metal substrates, especially the red rust formation on steel substrates.

Thus, the first object of the invention is an acidic aqueous concentrate suitable for the preparation of a conversion treatment solution comprising a) at least 0.1 wt.-%, preferably more than 1 wt.-% calculated with respect to the elements Zr and/or Ti of one or more water-soluble compounds of the elements Zr and/or Ti;

b) at least 0.05 wt.-%, preferably more than 0.5 wt.-% calculated with respect to the element Si of one or more organosilanes with at least one hydrolyzable substituent and one to three non-hydrolyzable substituents, wherein at least one of the non-hydrolyzable substituents carries at least one amino group, and wherein the total number of substituents at each silicon atom of the organosilanes is four;

c) at least 0.1 wt.-%, preferably more than 0.5 wt.-% calculated with respect to the element Si of one or more water-dispersible silicates;

wherein the pH of the concentrate is adjusted with nitric acid to a value below 1.5 and wherein the amount of other strong acids with a $pK_a$ value of below 1.5 but different from water-soluble compounds of the elements Zr and/or Ti is below 0.05 wt.-%, preferably below 0.01 wt.-%.

In the context of this invention hydrolyzable substituents of organosilanes are those substituents directly bound to the silicon atom that upon hydrolysis reaction split of as alcohols with a boiling point of less than 100° C. at 1 atm.

In the context of this invention non-hydrolyzable substituents of organosilanes have a carbon atom covalent bound to the silicon atom of the organosilane.

In the context of this invention the $pK_a$ value equals the negative logarithm to the base 10 of the standard thermodynamic equilibrium constant for the first deprotonation step of an acid in water.

The water-soluble compound of the elements Zr and/or Ti in a concentrate according to the invention is preferably selected from complex fluorides and/or complex oxyfluorides of the elements Zr and/or Ti, more preferably from fluorometallates of the element Zr and/or Ti. These preferred compounds have the advantage to release fluoride ions which enhance the conversion of the native oxide layer on the metal substrate during a pretreatment process that makes use of a diluted concentrate of this invention.

The concentrate of the invention preferably comprises not more than 5 wt-%, more preferably less than 2 wt.-% of one or more water-soluble compounds of the elements Zr and/or Ti calculated with respect to the elements Zr and/or Ti. A concentrate where the amount of these compounds exceeds 5 wt.-% calculated with respect to the elements Zr and/or Ti becomes increasingly unstable, so that the active components of the concentrate tend to precipitate giving rise to a shorter shelf-lifetime.

The organosilane of the concentrate is preferably selected from compounds according to the following general structure (I):

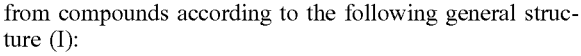

$$H_2N—[(CH_2)_mNH]_y(CH_2)_n—Si—X_3 \quad (I)$$

wherein the hydrolyzable substituents X are independently from each other selected from alkoxy groups with not more than 4, preferably not more than 2 carbon atoms, wherein m and n each independently from another are integral numbers in the range from 1 to 4 and wherein y is an integral number in the range from 0 to 8, preferably from 0 to 3. The most preferred organosilanes according to the general structure (I) are 3-(diethylenetriamino)propyltrimethoxysilane, 3-(ethylenediamino)propyltrimethoxysilane, 3-aminopropyltrimethoxysilane, 3-(diethylenetriamino)propyltriethoxysilane, 3-(ethylenediamino) propyltriethoxysilane and 3-aminopropyltriethoxysilane, especially preferred is 3-aminopropyltriethoxysilane.

The use of these types of organosilanes is favorable with respect to the corrosion protection performance when a diluted concentrate of the invention is applied to steel substrates. Moreover, the adhesion of subsequently applied organic primers or lacquers to such a conversion treated steel substrate is significantly improved.

The concentrate of the invention preferably comprises not more than 5 wt-%, more preferably less than 2 wt.-% of one or more organosilanes with at least one non-hydrolyzable substituent, wherein at least one non-hydrolyzable substituent carries an amino group, calculated with respect to the element Si. A concentrate where the amount of these compounds exceeds 5 wt.-% calculated with respect to the element Si becomes increasingly unstable, so that the active components of the concentrate tend to precipitate giving rise to a shorter shelf-lifetime.

The one or more water-dispersible silicates of a concentrate according the invention are preferably selected from nanoparticulate silicates, more preferably selected from chemically modified nanoparticulate silicates. Nanoparticulate in the sense of the underlying invention means that the silicates dispersed in the concentrate reveal a D90 value of less than 500 nm. A D90 value indicates that 90 vol.-% of the particles of a particulate composition are below the stated particle size. Such values can be determined from volume-weighted cumulative particle size distributions, which can be measured with the help of dynamic light scatter methods in a diluted concentrate with a particulate matter content of less than 1 wt.-%.

The nanoparticulate state of the silicates within the concentrate of the invention gives rise to a better corrosion protection performance when a diluted concentrate is applied to a metal surface in a conversion treatment process. Without being bound by any theory it is believed that the outmost surface layer of the nanoparticulate silicates undergoes condensation reactions with the organosilanes in the concentrate thereby the nanoparticles become modified with amino-functional groups. As long as the silicates are dispersed as nanoparticles a high surface area of the dispersed silicates becomes modified which in turn gives rise to a more thorough interaction of a metal substrate being conversion treated with a diluted concentrate of the invention and subsequently applied organic primers or lacquers.

In another preferred embodiment of a concentrate of the invention the nanoparticulate silicate is selected from aluminosilicates wherein the molar ratio of aluminum to silicon is at least 1:3, more preferably selected from aluminosilicates with the elemental formula $(Na, K)_x(Ca, Mg)_{1-x}Al_{2-x}Si_{2+x}O_8$ (with $0 \leq x \leq 1$). These types of silicates showed fewer tendencies to precipitate in a concentrate according to the invention.

The concentrate of the invention preferably comprises not more than 5 wt-%, more preferably less than 2 wt.-% of one or more water-dispersible silicates calculated with respect to the element Si. A concentrate where the amount of these compounds exceeds 5 wt.-% calculated with respect to the element Si becomes increasingly unstable, so that the active components of the concentrate tend to precipitate giving rise to a shorter shelf-lifetime.

In another preferred concentrate of the underlying invention the component a) calculated with respect to the elements Zr and/or Ti and the component b) calculated with respect to the element Si are comprised in a weight ratio of from 3:1 to 1:3, more preferably of from 2:1 to 1:2, and the component a) calculated with respect to the elements Zr and/or Ti and the component c) calculated with respect to the element Si are comprised in a weight ratio of from 3:1 to 1:3, more preferably of from 2:1 to 1:2.

The pH of a concentrate of this invention is preferably higher than 0.20, more preferably higher than 0.40, but preferably not higher than 1.45.

As nitric acid is mandatory for the pH adjustment of the concentrate in order to attain a stable concentrate of this invention, the amount of nitric acid in the concentrate is preferably above 500 ppm, more preferably above 800 ppm calculated as $NO_3$.

Another object of the invention consists in a conversion treatment solution with a pH in the range from 3.0 to 5.0 comprising a) at least 20 ppm, preferably less than 0.1 wt.-% of one or more water-soluble compounds of the elements Zr and/or Ti calculated with respect to the elements Zr and/or Ti, b) one or more organosilanes with at least one hydrolyzable substituent and one to three non-hydrolyzable substituents, wherein at least one of the non-hydrolyzable substituents carries at least one amino group, and wherein the total number of substituents at each silicon atom of the organosilanes is four, and c) of one or more water-dispersible silicates;

obtainable through dilution of a concentrate of this invention with water and adjustment of the pH with a base, wherein the concentrate preferably comprises the component a) calculated with respect to the elements Zr and/or Ti and the component b) calculated with respect to the element Si in a weight ratio of from 3:1 to 1:3, more preferably of from 2:1 to 1:2, and the component a) calculated with respect to the elements Zr and/or Ti and the component c) calculated with respect to the element Si in a weight ratio of from 3:1 to 1:3, more preferably of from 2:1 to 1:2.

Such a conversion treatment solution obtained from a concentrate of this invention confers superior corrosion resistance performance when applied to metal surfaces compared to a conversion treatment solution with the same amount of active ingredients but being prepared in-situ. Obviously hydrolysis and condensation reactions that occur inevitably when the compounds of Zr and/or Ti, silanes and silicates are mixed together does strongly depend on the concentration and pH of these components thereby giving rise to different results in a conversion coating process. A so-called "in-situ preparation" is performed by adding each component of a conversion treatment solution to a given portion of water so that the target concentration of each component according to the desired working composition is immediately achieved after addition of the components to the portion of water.

Another object of the invention further consists in a process for the corrosion-resistant treatment of metal parts that at least partially comprise surfaces of steel wherein the metal part is brought into contact with a conversion treatment solution obtainable through dilution of a concentrate of this invention and adjustment of the pH to a range of from 3.0 to 5.0, wherein dilution is preferably performed with water and in such an amount that the conversion treatment solution comprises in total at least 20 ppm of the at least one water-soluble compound of the elements Zr and/or Ti calculated with respect to the elements Zr and/or Ti.

The process of corrosion-resistant treatment can be followed by further coating steps, such as the application of organic primers, e-coats, lacquers and paints. These coatings are preferably directly applied to the conversion coated metal substrates. It is advantage of the process of this invention that after the wet-chemical treatment with a conversion treatment solution obtainable from the acidic aqueous concentrate and prior to the application of further organic coatings the wet metal surface is allowed to dry without any appearance of flash rust or any detrimental effect to the corrosion resistance of the conversion coated metal surface. This property of metal surfaces being conversion coated in accordance with the underlying invention is especially important in coating lines where structural elements of different type and shape are surface pretreated prior to the application of organic coatings and line stops belong to the normal operation mode.

The process of the invention is suitable for the corrosion-resistant treatment of steel, galvanized steel and aluminum.

EXAMPLES

Working examples of concentrates have been formulated based on an aqueous compositions containing 0.5 wt-% hexafluorozirconic acid. To such a composition 40% of the total amount of 3-aminopropyltriethoxysilane is added under stirring at 20° C. The total amount is 1.2 wt.-% 3-aminopropyltriethoxysilane. The residual amount of the organosilane is added after adjustment of the pH to value of 1.0 and adding of 0.8 wt.-% Ludox® TMA which is a alumina-modified silica sol containing 34 wt.-% of dispersed silicates. All weight percentages are calculated with respect to the final concentrate composition. Table 1 shows the stability of the concentrates for different strong acids used to adjust the pH.

TABLE 1

Stability of concentrate compositions being pH adjusted with different strong acids

| | Strong Acid | Stability[1] |
|---|---|---|
| E1 | $HNO_3$ | >12 months |
| CE1 | $H_2SO_4$ | <12 hours |
| CE2 | HCl | <24 hours |
| CE3 | HF | <24 hours |

[1]duration until precipitation becomes visible at 20° C.

Concentrate E1 and a concentrate CE4 differing from E1 only in that no organosilane is present were diluted with deionized water ($\kappa<1\ \mu Scm^{-1}$) to yield working compositions with an amount of zirconium of 500 ppm. Another working composition CE5 having the same amount of active components compared with the diluted concentrate E1 was prepared in-situ directly from the single components. The pH of all working compositions was adjusted to 5.0.

Cold rolled steel panels were then immersed for 3 minutes at 25° C. in these working compositions (E1, CE4 and CE5) and rinsed with water afterwards. A polyester-based organic powder coating (Interpon®610AB, Akzo Nobel) was then applied with a coating knife and cured at 180° C. to give a dry coating film thickness of 60 μpm. Table 2 shows the corrosion performance in the Neutral Salt Spray Test according to ASTM B117.

TABLE 2

Neutral Salt Spray Test according to ASTM B117 of different pretreated CRS panels coated with polyester-based organic powder coating

| | NSST[1]/mm |
|---|---|
| E1 | 1.3 |
| CE4 | 4.5 |
| CE5 | 2.6 |

[1]average creepage at scribe after 1000 h NSST of 3 test panels

What is claimed is:

1. An acidic aqueous concentrate, suitable for the preparation of a conversion-treatment solution, said acidic aqueous concentrate comprising components:

a. at least 0.1 wt.-%, calculated with respect to elements Zr and/or Ti, of one or more water-soluble compounds of the elements Zr and/or Ti;

b. at least 0.05 wt.-%, calculated with respect to Si, of one or more organosilanes with at least one hydrolyzable substituent and one to three non-hydrolyzable substituents, wherein at least one of the non-hydrolyzable substituents carries at least one amino group, and wherein the total number of substituents at each silicon atom of the one or more organosilanes is four; and c. at least 0.1 wt.-%, calculated with respect to Si, of one or more water-dispersible silicates;

wherein pH of the acidic aqueous concentrate is adjusted with nitric acid to a value below 1.5 and wherein other strong acids with a pKa value of below 1.5, different from water-soluble compounds of the elements Zr and/or Ti, are present in an amount of no greater than 0.05 wt.-%, components a., b. and c. combined with the nitric acid such that the acidic aqueous concentrate shows no visible precipitation for a duration of 12 months at 20° C.

2. The acidic aqueous concentrate according to claim 1, wherein the water-soluble compound of the elements Zr and/or Ti is selected from fluorometallates of the element Zr.

3. The acidic aqueous concentrate according to claim 1 wherein component a is present in an amount of more than 1 wt.-%, but not more than 5 wt.-%.

4. The acidic aqueous concentrate according to claim 1, wherein the one or more organosilanes is selected from compounds according to the following general structure (I):

$$H_2N—[(CH_2)_mNH]_y(CH_2)_n—Si—X_3 \quad (I)$$

wherein the hydrolyzable substituents X are, independently from each other, selected from alkoxy groups with not more than 4 carbon atoms, y is an integral number in a range from 0 to 8; and m and n, each independently from another, are integral numbers in a range from 1 to 4.

5. The acidic aqueous concentrate according to claim 4 wherein the hydrolyzable substituents X are, independently from each other, selected from alkoxy groups with not more than 2 carbon atoms.

6. The acidic aqueous concentrate according to claim 5 wherein y is in the range from 0 to 3.

7. The acidic aqueous concentrate according to claim 1 wherein component b is present in an amount of more than 0.5 wt.-%, but not more than 5.0 wt.-%.

8. The acidic aqueous concentrate according to claim 1, wherein the one or more water-dispersible silicates are selected from nanoparticulate silicates having a D90 value of less than 500 nm.

9. The acidic aqueous concentrate according to claim 8, wherein the nanoparticulate silicates comprise aluminosilicates.

10. The acidic aqueous concentrate according to claim 8, wherein the nanoparticulate silicates comprise aluminosilicates having a molar ratio of aluminum to silicon of at least 1:3.

11. The acidic aqueous concentrate according to claim 1 wherein pH of the concentrate is higher than 0.20, but not higher than 1.45.

12. The acidic aqueous concentrate according to claim 1 wherein nitric acid is present in the concentrate in an amount of greater than 500 ppm, calculated as $NO_3$.

13. The acidic aqueous concentrate according to claim 1 wherein component a, calculated with respect to the elements Zr and/or Ti, and component b, calculated with respect to the element Si, have a weight ratio of a:b of from 3:1 to 1:3; and component a, calculated with respect to the elements Zr and/or Ti, and component c, calculated with respect to the element Si, have a weight ratio of a:c of from 3:1 to 1:3.

14. A conversion treatment solution comprising:

a) at least 20 ppm of one or more water-soluble compounds of elements Zr and/or Ti calculated with respect to the elements Zr and/or Ti, b) one or more organosilanes with at least one hydrolyzable substituent and one to three non hydrolyzable substituents, wherein at least one of the non hydrolyzable substituents carries at least one amino group, and wherein a total number of substituents at each silicon atom of the one or more organosilanes is four, and c) one or more water-dispersible silicates;

having a pH in the range from 3.0 to 5.0 and obtained through dilution of the concentrate according to claim 1 with water and adjustment of the pH with a base.

15. A process for corrosion-resistant treatment of a metal part that at least partially comprises surfaces of steel comprising contacting the metal part with a conversion treatment solution according to claim 14.

16. An acidic aqueous concentrate suitable for the preparation of a conversion-treatment solution comprising:

a. at least 0.1 wt.-%, calculated with respect to elements Zr and/or Ti, of one or more water-soluble compounds of the elements Zr and/or Ti;

b. at least 0.05 wt.-%, calculated with respect to Si, of one or more orqanosilanes with at least one hydrolyzable substituent and one to three non-hydrolyzable substituents, wherein at least one of the non-hydrolyzable substituents carries at least one amino group, and wherein the total number of substituents at each silicon atom of the one or more orqanosilanes is four; and c. at least 0.1 wt.-%, calculated with respect to Si, of one or more water-dispersible silicates selected from nanoparticulate silicates;

wherein pH of the acidic aqueous concentrate is adjusted with nitric acid to a value below 1.5 and wherein other strong acids with a pKa value of below 1.5, different from water-soluble compounds of the elements Zr and/or Ti, are present in an amount of no greater than 0.05 wt.-%; and wherein the nanoparticulate silicates comprise aluminosilicates having an elemental formula of:

$$(Na, K)_x(Ca, Mg)_{1-x}Al_{2-x}Si_{2=x}O_8$$

wherein $0 \leq x \leq 1$.

17. The acidic aqueous concentrate according to claim 16 wherein component c is present in an amount of more than 0.5 wt.-%, but not more than 5.0 wt.-%.

18. An acidic aqueous concentrate suitable for the preparation of a conversion-treatment solution consisting essentially of:

a. 0.1 wt.-% to 5 wt.-%, calculated with respect to elements Zr and/or Ti, of one or more water-soluble compounds of the elements Zr and/or Ti;

b. 0.05 wt.-% to 5 wt.-%, calculated with respect to Si, of one or more organosilanes with at least one hydrolyzable substituent and one to three non-hydrolyzable substituents, wherein at least one of the non-hydrolyzable substituents carries at least one amino group, and wherein the total number of substituents at each silicon atom of the one or more organosilanes is four; and c. 0.1 wt.-% to 5 wt.-%, calculated with respect to Si, of one or more water-dispersible silicates;

wherein pH of the acidic aqueous concentrate is adjusted with nitric acid to a value higher than 0.20 and below 1.5 and other strong acids with a pKa value of below 1.5, different from water-soluble compounds of the elements Zr and/or Ti, are present in an amount of no greater than 0.05 wt.-%, such that the acidic aqueous concentrate shows no visible precipitation for a duration of 12 months at 20° C.

19. The acidic aqueous concentrate according to claim 18 wherein the nitric acid is present in an amount of greater than 500 ppm, calculated as $NO_3$, and the other strong acids with a pKa value of below 1.5, different from water-soluble compounds of the elements Zr and/or Ti, are present in an amount of no greater than 0.01 wt.-%.

* * * * *